US005659929A

United States Patent [19]

Cheng

[11] Patent Number: 5,659,929

[45] Date of Patent: Aug. 26, 1997

[54] MULTI-FUNCTION HINGE STRUCTURE

[76] Inventor: Lin Ming Cheng, P.O. Box 87-280, Taipei, Taiwan

[21] Appl. No.: 579,443

[22] Filed: Dec. 27, 1995

[51] Int. Cl.[6] ..... E05D 3/06

[52] U.S. Cl. ..... 16/366

[58] Field of Search ..... 16/366, 354, 387

[56] References Cited

U.S. PATENT DOCUMENTS

| | | | |
|---|---|---|---|
| 110,659 | 1/1871 | Jenness | 16/366 |
| 255,809 | 4/1882 | Pfauntz et al. | 16/366 |
| 368,539 | 8/1887 | Ludlow | 16/366 |
| 378,861 | 3/1888 | Atwood | 16/366 |
| 401,086 | 4/1889 | Turner | 16/366 |
| 888,531 | 5/1908 | Raith | 16/366 |
| 1,031,745 | 7/1912 | Unckrich | 16/366 |
| 1,268,104 | 6/1918 | Flick et al. | 16/366 |
| 5,493,760 | 2/1996 | Takimoto | 16/366 |

FOREIGN PATENT DOCUMENTS

| | | | |
|---|---|---|---|
| 431736 | 7/1920 | Germany | 16/366 |

*Primary Examiner*—Chuck Y. Mah

*Attorney, Agent, or Firm*—W. Wayne Liauh

[57] ABSTRACT

An improved multi-function hinge structure is disclosed. It contains: (a) two substantially symmetrical wing plates (20, 21), wherein each of the wind plates has a substantially rectangle-shaped notch (25) on an inner edge (31) thereof and a pair of round surfaces (32) separated by the rectangularly-shaped notch; (b) a connecting plate (23) received by the rectangle-shaped notches collectively; and a pair of pivots (26) for connecting the wing plates with the connecting plate together to form a hinge. The connecting plate is substantially rectangular in shape with two round edge surfaces (33) facing the wings plates, respectively. Each of the round edge surfaces of the connecting plate and a corresponding round surface of the wing plate are on the same circumference of a fictitious circle centered at a corresponding pivot, so as allow the hinge plates to turn from 0° to 360° relative to each other.

2 Claims, 5 Drawing Sheets

MULTI-FUNCTION HINGE STRUCTURE

BACKGROUND OF THE INVENTION

1. Field of the Invention:

This invention relates to a multi-function hinge structure, and particularly to a structure to form into a flat plane able to turn at an angle of 360 degrees freely, to connect two objects with a hinge.

2. Description of the Prior Art:

As shown in FIG. 1, it is a perspective view of a conventional hinge, which comprises two wing plates 10 and 11, several screw holes 12, several cylinder portions 16 and a pivot 14. The left side of the hinge is a square-shaped first wing plate 10, while the right side thereof is a second wing plate 11 being symmetrical to the first wing plate. The screw holes 12 are furnished in the two wing plates 10 and 11 correspondingly. The inner sides of the two wing plates 10 and 11 are furnished with several cylinder portions 16 respectively, which are fitted with a pivot 14 so as to connect the two wing plates 10 and 11 together. Referring to FIGS. 2 and 3, they illustrate two side views of the conventional hinge; it is apparent that when the two wing plates 10 and 11 are arranged at an angle of 180 degrees or zero degree, the cylinder portions 16 and the pivot 14 are always exposed out of the plane of the two using plates 10 and 11, i.e., the thickness of the cylinder portions 16 and the pivot 14 is larger than that of the wing plates 10 and 11.

Referring to FIG. 4, it illustrates a conventional hinge mounted between a door 28 and a wall 30; apparently, both the cylinder portion 16 and the pivot 14 are set out of the surface formed with the door and the wall; in that case, the hinge not only spoils the design beauty of the whole mounting environment, but also is subject to hooking a passer-by's clothing; further, such a hinge is unable to turn at an angle of 360 degrees freely in real use.

SUMMARY OF THE INVENTION

The prime object of the present invention is to provide a multi-function hinge structure, which can be mounted between two objects that need to be hinged together.

Another object of the present invention is to provide a multi-function hinge structure, in which a connecting plate is fitted between the two wing plates, and the thickness of the connecting plate is equal to that of the two wing plates so as to overcome the drawback of the conventional hinge, of which the cylinder portions and the pivot are projected out of the plane of the two objects hinged together. Since the thickness of the connecting plate and the two wing plates is the same, all the three parts are arranged on one identical surface.

Still another object of the present invention is to provide a multi-function hinge struction, of which the turning angle is not limited, i.e., able to turn 360 degrees freely; therefore, a user can set two objects hinged together at any angle as desired.

DETAILED DESCRIPTION

Figure 2:
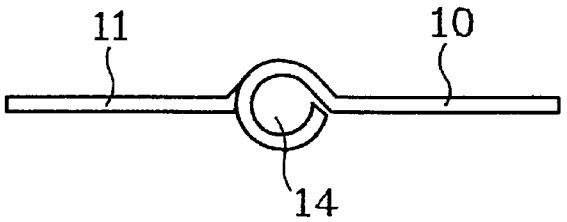
FIG.2 (PRIOR ART)
FIG. 2 is a side view of the conventional hinge as shown in FIG. 1.
Figure 3:
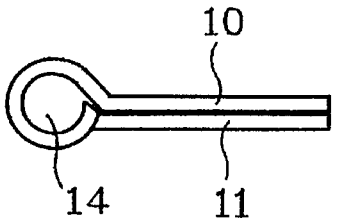
FIG.3 (PRIOR ART)
FIG. 3 is another side view of the conventional hinge as shown in FIG. 1.
Figure 1:
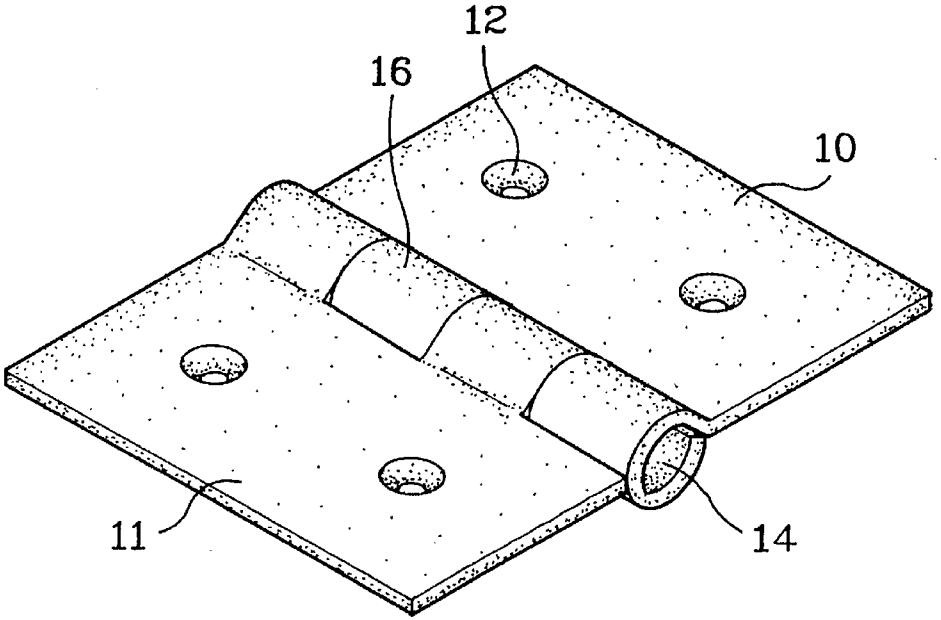
FIG.1 (PRIOR ART)
FIG. 1 is a perspective view of a conventional hinge.
Figure 4:
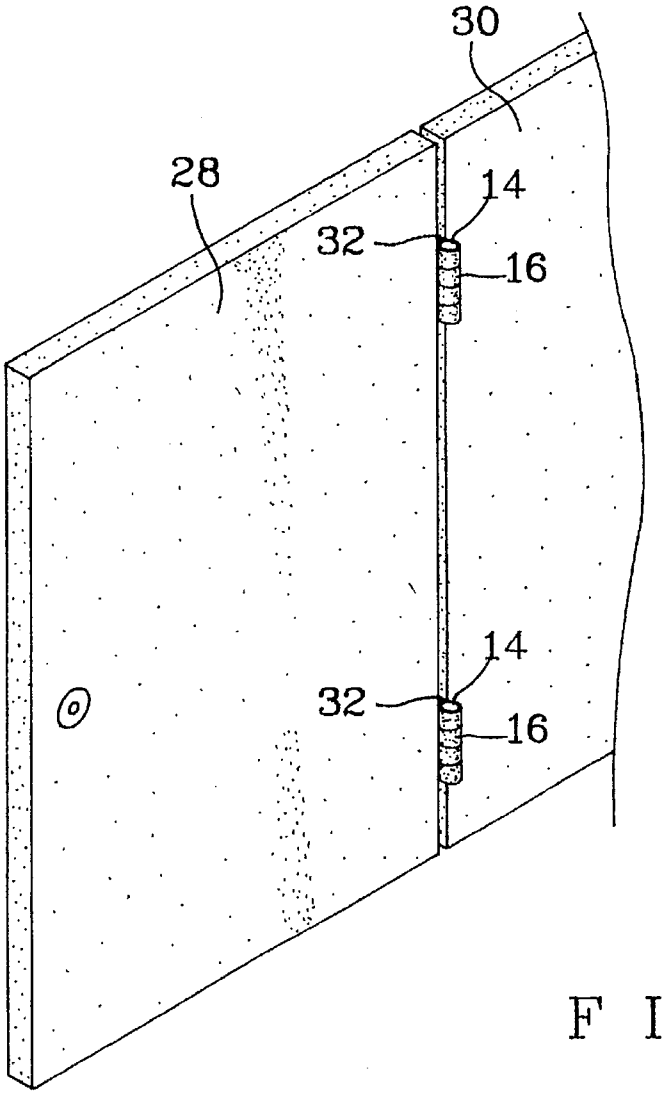
FIG. 4 illustrates the conventional hinge mounted on a door.
Figure 5:
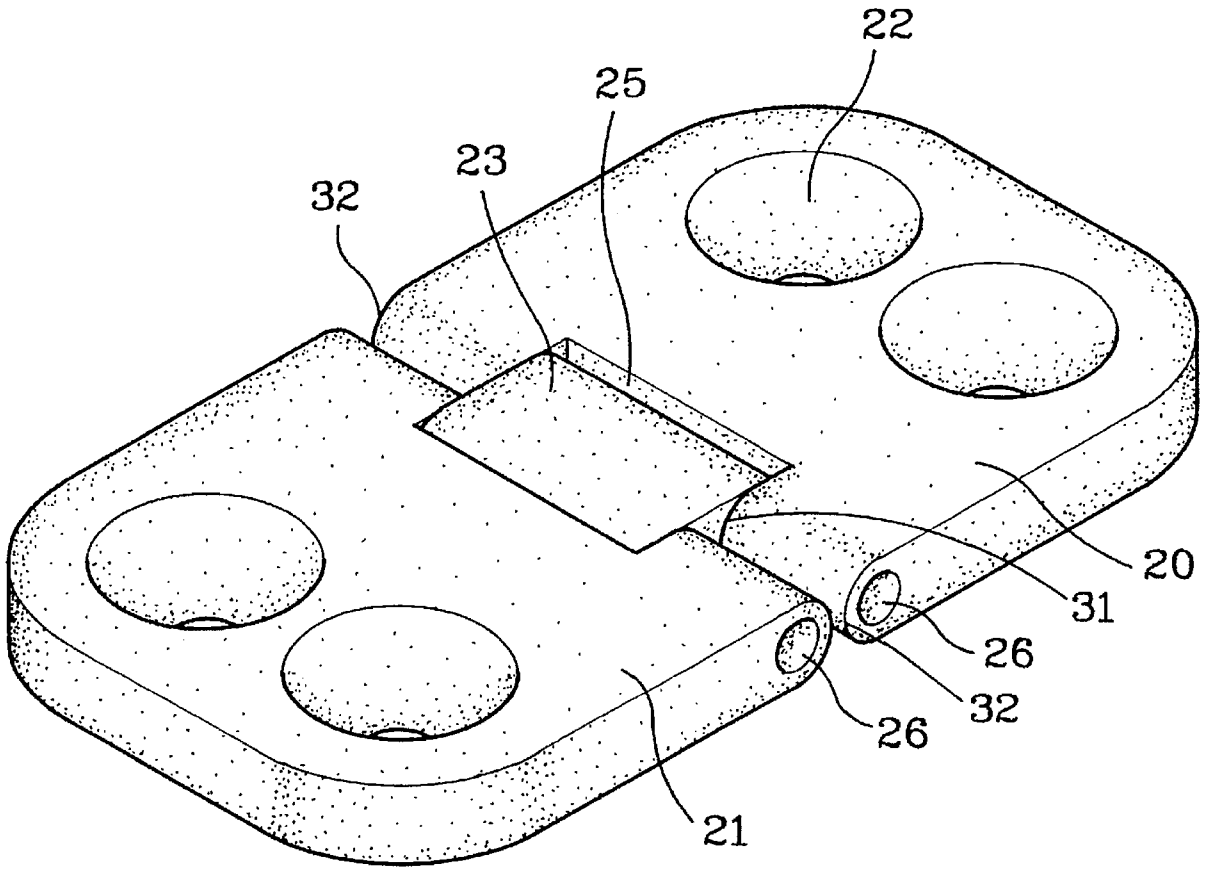
FIG. 5 is a perspective view of a hinge according to the present invention.

The object, features and functions of the present invention are further described with the accompanying drawings as follows:

Referring to FIG. 5, the perspective view of the present invention comprises two wing plates 20 and 21, screw holes 22, a connecting plate 23 and pivots 26. The left side thereof is a first wing plate 21 in square shape, of which the inner edge has a U-shaped recess part 25. The right side thereof is a second wing plate 20, being symmetrical to the first wing plate, and also has a U-shaped recess part 25; the two recess parts 25 form into a rectangular hole. Each of the two wing plates 20 and 21 is provided with several screw holes 22. The screw holes 22 of the two wing plates 20 and 21 are arranged symmetrically. The connecting plate 23 is a rectangular plate mounted in the rectangular hole formed with the two recess parts 25; the thickness of the connecting plate 23 is the same as that of the wing plates 20 and 21 so as to have the whole hinge formed into a smooth flat surface. The inner opposite sides of the two wing plates 20 and 21 are furnished with two pivots 26 respectively. The pivots 26 pass through both ends of the connecting plate 23 and the two wing plates 20 and 21 so as to have the connecting plate 23 and the two wing plates 20 and 21 connected together as one piece, and to turn at an angle of 360 degrees.

Figure 6:
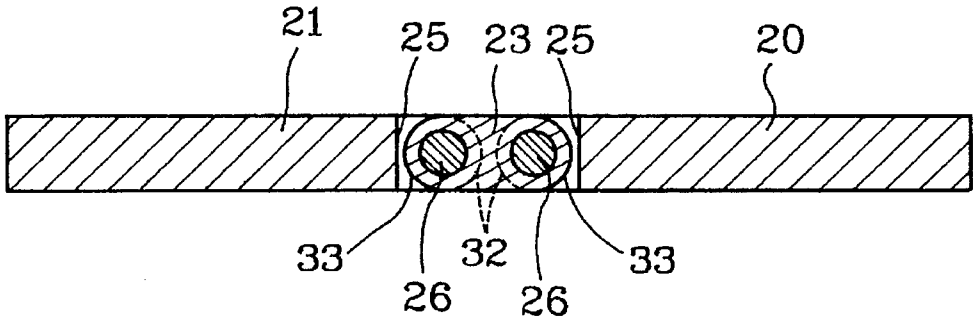
FIG. 6 is a sectional side view of the hinge according to the present invention.
Figure 7:
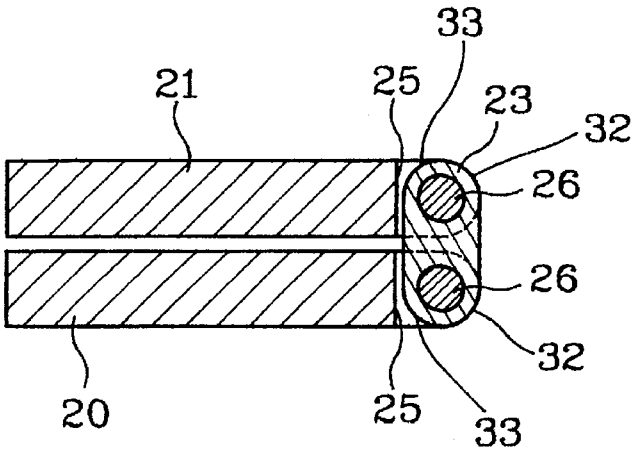
FIG. 7 is another sectional side view of the hinge according to the present invention.

FIGS. 6 and 7 illustrate two sectional side views of the present invention; when the two wing plates 20 and 21 are turned at an angle of 180 degrees or zero degree, the pivots 26 and the connecting plate 23 are always formed into a flat plane within the plane formed by the two wing plates 20 and 21; therefore, the hinge can be turned at any angle without limit, i.e., a user can use it in the most convenient way.

Figure 8:
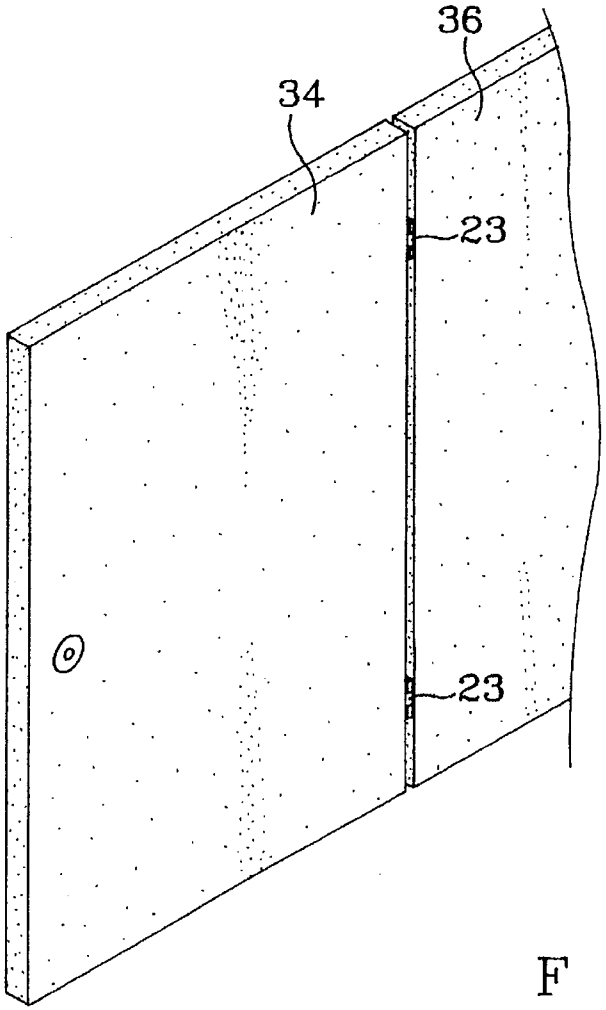
FIG. 8 illustrates the hinge according to the present invention mounted on a door.

Referring to FIG. 8, it illustrates the hinge mounted between a door 34 and a wall 36; it is apparent that the connecting plate 23, the door 34 and the wall 36 are arranged on one flat surface without hooking the clothing of a passer-by and without spoiling the design beauty.

According to the present invention, the structure of the hinge is deemed simple, and the connecting plate and pivots thereof have been improved greatly. Since the pivot is fitted through the inside of the wing plates and the connecting plate, the wing plate can be designed into a square piece integrally. In the conventional hinge, the inner edge thereof has to be furnished with several cylinder portions to facilitate a pivot to fit through; further, the connecting plate has the same thickness as that of the two way plates, the hinge will be at the same flat surface as that of two objects to be hinged together. Since the hinge can turned at an angle of 360 degrees, one of the two objects to be hinged together can be turned at an angle of 360 degrees by using the other object as a center, while the turning angle of a conventional hinge is limited. The present invention can provide a user with a large angle without causing any inconvenience.

I claim:

1. A multi-function hinge structure for hinging two objects together consisting of:

two substantially symmetrical wing plates, wherein each of said wing plates has a substantially rectangle-shaped notch on an inner edge thereof and a pair of round surfaces separated by said rectangularly-shaped notch;

a plurality of screw holes formed in each said wing plate;

a connecting plate received by said rectangle-shaped notchs collectively; and a pair of pivots for connecting said wing plates with said connecting plate together to form a hinge;

wherein said connecting plate is substantially rectangular in shape with two round edge surfaces facing said wings plates, respectively;

further wherein each of said round edge surfaces of said connecting plate and a corresponding round surface of said wing plate are on the same circumference of a fictitious circle centered at a corresponding pivot, so as allow said hinge plates to turn from 0° to 360° relative to each other.

2. The multi-function hinge structure as claimed in claim 1, wherein said connecting plate has a thickness substantially equal to that of said two wing plates.

* * * * *